US011939095B2

(12) United States Patent
Vari

(10) Patent No.: US 11,939,095 B2
(45) **Date of Patent: *Mar. 26, 2024**

(54) APPARATUS FOR SEALING OPEN-TOPPED CONTAINERS WITH HEAT-SHRINKING FILM MATERIAL

(71) Applicant: GPCP IP HOLDINGS LLC, Atlanta, GA (US)

(72) Inventor: Kimmo Vari, Brampton (CA)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,913

(22) Filed: May 17, 2022

(65) Prior Publication Data

US 2022/0274726 A1 Sep. 1, 2022

Related U.S. Application Data

(63) Continuation of application No. 16/487,907, filed as application No. PCT/IB2018/000133 on Feb. 22, 2018, now Pat. No. 11,358,742.

(Continued)

(51) Int. Cl.
*B65B 41/16* (2006.01)
*B65B 7/16* (2006.01)

(Continued)

(52) U.S. Cl.
CPC ..... *B65B 41/16* (2013.01); *B65B 7/164* (2013.01); *B65B 7/167* (2013.01); *B65B 53/066* (2013.01);

(Continued)

(58) Field of Classification Search
CPC ..... B65B 7/2807; B65B 7/2885; B65B 7/162; B65B 7/164; B65B 7/167; B65B 41/16;

(Continued)

(56) References Cited

U.S. PATENT DOCUMENTS 2,785,519 A * 3/1957 Rumsey, Jr. ..... B65B 53/04 53/557
3,101,913 A 8/1963 Davis (Continued)

FOREIGN PATENT DOCUMENTS

CN 201424140 Y 3/2010
CN 201793027 U 4/2011

(Continued)

OTHER PUBLICATIONS

Office Action received from Japanese Patent Application No. 2019546334, dated Aug. 30, 2022, 5 pages (2 pages of English Translation and 3 pages of official notification).

(Continued)

*Primary Examiner* — Stephen F. Gerrity

(57) ABSTRACT

System for heat shrink sealing open-topped containers wherein the system includes a housing or enclosure wherein a majority of a bulk roll of film material is accessible when the cover is open. The system preferably includes two opposing rollers that are configured to engage the film and cause it to move to a dispensing position. In a preferred aspect, the system includes a movable sealing unit that accommodates use of the lidding system with open ended containers having various sizes and shapes. In a more preferred aspect, the system includes an indicia generating device operable to label sealed containers and a knife that generates a perforation in the film during sealing operations.

6 Claims, 7 Drawing Sheets

Related U.S. Application Data

(60) Provisional application No. 62/463,101, filed on Feb. 24, 2017.

(51) Int. Cl.

| | |
|---|---|
| ***B65B 53/06*** | (2006.01) |
| ***B65B 59/00*** | (2006.01) |
| ***B65B 61/02*** | (2006.01) |
| ***B65B 61/18*** | (2006.01) |
| ***B65B 61/26*** | (2006.01) |

(52) U.S. Cl.
CPC ..... *B65B 59/003* (2019.05); *B65B 61/02* (2013.01); *B65B 61/18* (2013.01); *B65B 61/26* (2013.01)

(58) Field of Classification Search
CPC ..... B65B 51/144; B65B 51/148; B65B 53/02; B65B 53/066; B65B 59/003; B65B 59/04; B65B 61/02; B65B 61/18; B65B 61/26
USPC ..... 53/478, 131.3, 133.1, 557, 329.2, 329.3, 53/329.5
See application file for complete search history.

(56) References Cited

U.S. PATENT DOCUMENTS

| | | | | |
|---|---|---|---|---|
| 3,262,245 | A | 7/1966 | Snow, Jr. | |
| 3,286,437 | A | 11/1966 | Melvin | |
| 3,345,797 | A | 10/1967 | Von | |
| 3,354,604 | A | 11/1967 | Amberg et al. | |
| 3,354,614 | A * | 11/1967 | Clair et al. | B65B 43/50 53/329.2 |
| 3,378,991 | A | 4/1968 | Anderson | |
| 3,501,896 | A | 3/1970 | Stoeser et al. | |
| 3,507,093 | A | 4/1970 | Marion | |
| 3,583,888 | A * | 6/1971 | Shanklin | B65B 59/00 53/568 |
| 3,783,582 | A | 1/1974 | Willvonseder | |
| 3,838,550 | A | 10/1974 | Mueller | |
| 3,838,805 | A | 10/1974 | Amberg | |
| 3,877,200 | A * | 4/1975 | Feldman | B65B 7/167 53/329 |
| 3,937,645 | A | 2/1976 | Ascoli et al. | |
| 4,050,971 | A | 9/1977 | Verkins | |
| 4,078,360 | A | 3/1978 | Balzer | |
| 4,092,817 | A | 6/1978 | Rist, III | |
| 4,134,248 | A | 1/1979 | Freeman | |
| 4,184,310 | A * | 1/1980 | Shelby | B29C 66/73715 426/123 |
| 4,282,698 | A * | 8/1981 | Zimmermann | B65B 43/44 53/131.5 |
| 4,345,412 | A | 8/1982 | Balzer et al. | |
| 5,249,410 | A | 10/1993 | Bakker | |
| 5,658,421 | A | 8/1997 | Carroll | |
| 5,993,942 | A | 11/1999 | Bakker | |
| 6,775,472 | B2 | 8/2004 | Bakker | |
| 7,089,718 | B2 | 8/2006 | Biba | |
| 7,395,645 | B2 | 7/2008 | Biba | |
| 9,463,891 | B2 | 10/2016 | Owen | |
| 11,358,742 | B2 * | 6/2022 | Vari et al. | B65B 61/02 |
| 2003/0015274 | A1 | 1/2003 | Mallman | |
| 2003/0019188 | A1 | 1/2003 | Biba | |
| 2003/0021969 | A1 | 1/2003 | Aloisi | |
| 2003/0061922 | A1 | 4/2003 | Biba | |
| 2003/0200725 | A1 | 10/2003 | Aloisi | |
| 2003/0228964 | A1 | 12/2003 | Biba | |
| 2004/0020171 | A1 | 2/2004 | Biba | |
| 2004/0031243 | A1 | 2/2004 | Aloisi | |
| 2004/0035088 | A1 | 2/2004 | Loeffler | |
| 2004/0045257 | A1 | 3/2004 | Bakker | |
| 2004/0068968 | A1 | 4/2004 | Biba | |
| 2007/0107379 | A1 | 5/2007 | Dewey et al. | |
| 2010/0095638 | A1 * | 4/2010 | Zakowski et al. | B65B 31/046 53/511 |
| 2014/0041748 | A1 | 2/2014 | Angus | |
| 2016/0355282 | A1 * | 12/2016 | Valli | B65B 7/162 |

FOREIGN PATENT DOCUMENTS

| | | | | |
|---|---|---|---|---|
| CN | 203544484 | U | 4/2014 | |
| CN | 203793759 | U | 8/2014 | |
| EP | 1125840 | A2 | 8/2001 | |
| FR | 2157745 | A1 | 6/1973 | |
| FR | 2332178 | A1 | 6/1977 | |
| JP | S5372666 | U | 6/1978 | |
| JP | H0610107 | U | 2/1994 | |
| JP | 2005014972 | A | 1/2005 | |
| JP | 2005014972 | A * | 1/2005 | |
| JP | 2008512320 | A | 4/2008 | |
| JP | 2013095468 | A | 5/2013 | |
| JP | 3203848 | U | 4/2016 | |
| JP | 2018065592 | A | 4/2018 | |
| KR | 20140137133 | A * | 12/2014 | B65B 7/164 |
| KR | 101718142 | B1 | 3/2017 | |
| WO | 2011153610 | A2 | 12/2011 | |
| WO | 2020014183 | A1 | 1/2020 | |

OTHER PUBLICATIONS

Clean Step XTC Product website accessed at http://www.cleanstep.pl/technologia on Mar. 24, 2021, 4 pages.
Extended European Search Report for Application No. 18757732.5 dated Dec. 1, 2020, 8 pages.
Final Rejection received for U.S. Appl. No. 16/487,907, dated Aug. 16, 2021, 15 Pages.
International Preliminary Report on Patentability received for PCT Application No. PCT/IB2018/000133, dated Sep. 6, 2019, 09 Pages.
International Search Report and Written Opinion mailed in International Application No. PCT/IB2018/000133 dated Jun. 8, 2018, 11 Pages.
James, A.J., "Useful for places where you can't take your shoes off", accessed at https://www.linkedin.com/posts/sayed-saif-pmp%C2%AE-837a063b_useful-for-places-where-you-cant-take-your-ugcPost-6770449686890332161-HHwD, retrieved on Mar. 10, 2021, 2 pages.
Non-Final Rejection received for U.S. Appl. No. 16/487,907, dated Apr. 15, 2021, 18 pages.
Office Action received for JP Application No. 2019-546334, dated Feb. 1, 2022, 08 Pages (04 Pages of English Translation and 04 Pages of Official notification).

* cited by examiner

APPARATUS FOR SEALING OPEN-TOPPED CONTAINERS WITH HEAT-SHRINKING FILM MATERIAL

CROSS-REFERENCE TO RELATED APPLICATIONS

This application is a continuation of U.S. patent application Ser. No. 16/487,907, filed Aug. 22, 2019, now U.S. Pat. No. 11,358,742, issued Jun. 14, 2022, which is a national phase application of PCT Application No. PCT/IB2018/000113, filed Feb. 22, 2018, which claims priority to U.S. Provisional Application No. 62/463,101, filed on Feb. 24, 2017, the entire contents of which are hereby expressly incorporated by reference into this application.

BACKGROUND OF THE INVENTION

The present application pertains to an apparatus and methods for heat sealing a film material onto an open-topped container, such as a cup. Various features associated with the construction and operation of such systems are disclosed in Applicant's related U.S. Pat. Nos. 5,249,410; 5,993,942; 6,775,472; 7,089,718; 7,395,645; U.S. Patent Application Publication Nos. 2003/0015274; 2003/0019188; 2003/0021969; 2003/0061922; 2003/0200725; 2003/0228964; 2004/0020171; 2004/0031243; 2004/0035088; 2004/0045257; 2004/70068968; and various foreign counterparts associated therewith. The disclosures of which are expressly incorporated herein.

Even in view of the extensive contribution to the art attributable to the present applicant, there exist needs to improve the function, operation, service, and user interaction with such systems. Still further, a need exists to improve the efficiency with which such heat sealing devices can be manufactured, operated, and serviced as well as satisfy ever varying user demands associated with the production and presentation of the resultant sealed containers.

For instance, one shortcoming associated with such prior art devices relates to difficulties users experience when refilling the dispenser assembly associated with continuously or sequentially presenting the firm associated with the seal material. Commonly, the film material is provided as a roll of material that is supported relative to an enclosure. The bulk roll of material is commonly maintained in close proximity to the interior facing walls of an enclosure and an end of the roll must be passed through a guide arrangement to achieve the desired translation or unwinding of the roll during use. The limited space, sometimes tortious guide path, and limited visibility associated with positioning a bulk or replacement roll of heat sealable material relative to the dispenser housing complicates the reloading process and detracts from efficient use of personnel and equipment. Accordingly, there is a need for a film dispensing assembly that can be more efficiently and conveniently reloaded.

Another shortcoming associated with existing sealing apparatus relates to the limited ability of such systems to interact with containers of alternate shapes. That is, known sealing devices commonly interact in a sealing manner with containers having only a single shape or a very limited deviation associated with the size and shape of the container. There is a need for a firm sealing apparatus that can be quickly and conveniently configured for use with containers having various sizes and shapes.

There is a further need for a sealing apparatus or system wherein one or more discrete sub-assemblies, such as a film drive module, fun shrink module, electronics module, or frame module can cooperate with subassemblies associated with other sealing assemblies. For instance, it is appreciated that the sealing apparatus configured to cooperate with various shaped containers can be configured to cooperate with already owned sealing assemblies such that a previously purchased sealing assembly can be implemented for sealing containers having other shapes and sizes without requiring replacement or purchase of an entire alternate seal material drive, shrink, control, and/or frame assembly. Such considerations would further improve the serviceability of such sealing system in that only that portion of the assembly that requires service can be replaced and/or more conveniently be shipped for servicing.

Various advantages associated with the assemblies of the present application are set forth in the following description and may be apparent from the description or may be learned by practice of the invention. The advantages of the assembly associated with the present application may be realized and attained by means of the instrumentalities and combinations particularly pointed out in the appended claims and equivalents thereof.

SUMMARY OF THE INVENTION

The present application relates to systems, assemblies, and methods for heat-shrinking a film onto an open-topped container. Such lidding systems may include a two-part housing or enclosure wherein a portion of a movable cover exposes at least one end portion of the roll of film material when the cover is open. The system may also include a movable feed roll that improves the efficiency associated with reloading operations. Another aspect of the application discloses a movable sealing unit that accommodates use of the lidding system with open ended containers having various sizes and shapes. Other aspects of the system may include a laser-based marking device associated generating an indicia in the sealing film and a fixed position knife configured to generate a discontinuity such as a partial or incomplete or complete depression, serration, and/or perforation in the film during sealing operations such as to accommodate subsequent passage of a straw or other utensil therethrough.

In accordance with one aspect of the application, a system for heat-shrinking a film onto an open-topped container includes a feed mechanism, a seal assembly proximate the dispense location, and a housing having a base and a cover. The feed mechanism is configured to communicate a film material from a bulk roll to a dispense location. The seal assembly is configured to allow contact between the film material and an open end of a container. The base of the housing is configured to support the feed mechanism, and the cover of the housing is movably connected to the base and overlaps at least a portion of an end of the roll of firm material.

According to another aspect of the application, the cover of the housing and the base of the housing are pivotably connected to one another. An axis of rotation between the cover and the base of the housing is located beneath or generally vertically lower than an axis associated with rotation of the bulk roll. A handle may be attached to the cover at a location that is offset from an axis of rotation of the cover relative to the base.

According to yet another aspect of the application, the feed mechanism may also include a feed roll supported by a feed cover. The feed cover may be pivotably connected to the base of the housing. In addition, the seal assembly may be movably attached to the housing. For example, the seal assembly may be movably attached to the base of the housing.

In accordance with another aspect of the application, an apparatus for lidding an open container includes a housing configured to support a roll of a film lidding material, a feed mechanism constructed to communicate a portion of the film lidding material from the housing toward a dispense location, and a sealing assembly attached to the housing and constructed to present the film lidding material for interaction with an open end of a container disposed proximate thereto. The sealing assembly is movable relative to the housing between a first position and a second position. The first position is associated with placement of an open container, and the second position is associated with establishing contact between the film of the lidding material and the open end of a respective container. A handle may be attached to the sealing mechanism and pivotably attached to the housing to assist with transitioning the sealing assembly between the first and second positions to effectuate the sealing operation.

According to yet another aspect of the application, the housing includes a base and a cover. The cover is movable relative to the base. When the cover is closed, a majority of the roll of film material is disposed between opposing walls of the cover. In addition, the feed mechanism may include a mount plate that supports a feed roll and is pivotable secured to the base of the housing.

According to another aspect of the application, the apparatus may include a marking system configured to create an indicia in the film. For example, the marking system may include a laser module.

According to yet another aspect of the application, the apparatus may include a blade that is oriented and movable so as to selectively perforate the film. The blade may be supported by the sealing assembly. The apparatus may also include a bottom tray associated with the sealing assembly and a chassis associated with the housing. The bottom tray and/or chassis may be formed by injection molding processes.

In accordance with yet another aspect of the application, a method of forming an open container film sealing assembly includes providing a feed assembly supported by a chassis and providing a cover that movably cooperates with the chassis such that the cover and chassis generally enclose the feed assembly. The feed assembly is configured to communicate a film material from a bulk roll of film material to a sealing assembly. The cover and chassis are configured to substantially enclose the bulk roll when closed, while a majority of at least one end of the bulk roll is exposed to atmosphere when the cover is open relative to the chassis.

According to another aspect of the application, a majority of each of the opposite ends of the bulk roll of film material may be exposed when the cover is open. The method may include supporting a feed roll of the feed assembly with a feed cover. The feed cover may be pivotably connected to the chassis. The method may also include movably connecting the sealing assembly to the chassis so that the sealing assembly is movable in a vertical direction relative to the chassis.

According to yet another aspect of the application, the method may include providing a knife associated with the sealing assembly. The knife is oriented to selectively partially or fully perforate the film material during sealing of an open end of a container. The method may also include providing an engraver configured to generate an indicia in the film material. The engraver may be a laser.

These and other aspects and objects of the present application will be better appreciated and understood when considered in conjunction with the following description and the accompanying drawings. It should be understood, however, that the following description, while indicating preferred embodiments of the present application, is given by way of illustration and not of limitation. Many changes and modifications may be made within the scope of the present application without departing from the spirit thereof, and the invention includes all such modifications.

DESCRIPTION OF THE DRAWINGS

A clear conception of the advantages and features constituting the present invention, and of the construction and operation of typical embodiments of the present invention, will become more readily apparent by referring to the exemplary, and, therefore, non-limiting, embodiments illustrated in the drawings accompanying and forming a part of this specification, wherein like reference numerals designate the same elements in the several views.

In the drawings.

DETAILED DESCRIPTION OF THE PREFERRED EMBODIMENTS

As embodied and broadly described herein, the present application discloses various features of a lidding system for heat-shrinking a film onto an open-topped container. The respective lidding system includes a film drive or feed mechanism configured to dispense the firm for interaction with an open-topped container and such that the film can be heat sealed thereto.

Reference will now be made in detail to embodiments of the present application, examples of which are illustrated in the accompanying drawings. While the following description is directed to open-topped containers, such as cups, those of ordinary skill in the art will appreciate that the invention is equally applicable to other open-topped containers, including, but not limited to, food cartons and pharmaceutical containers.

Figure 1:
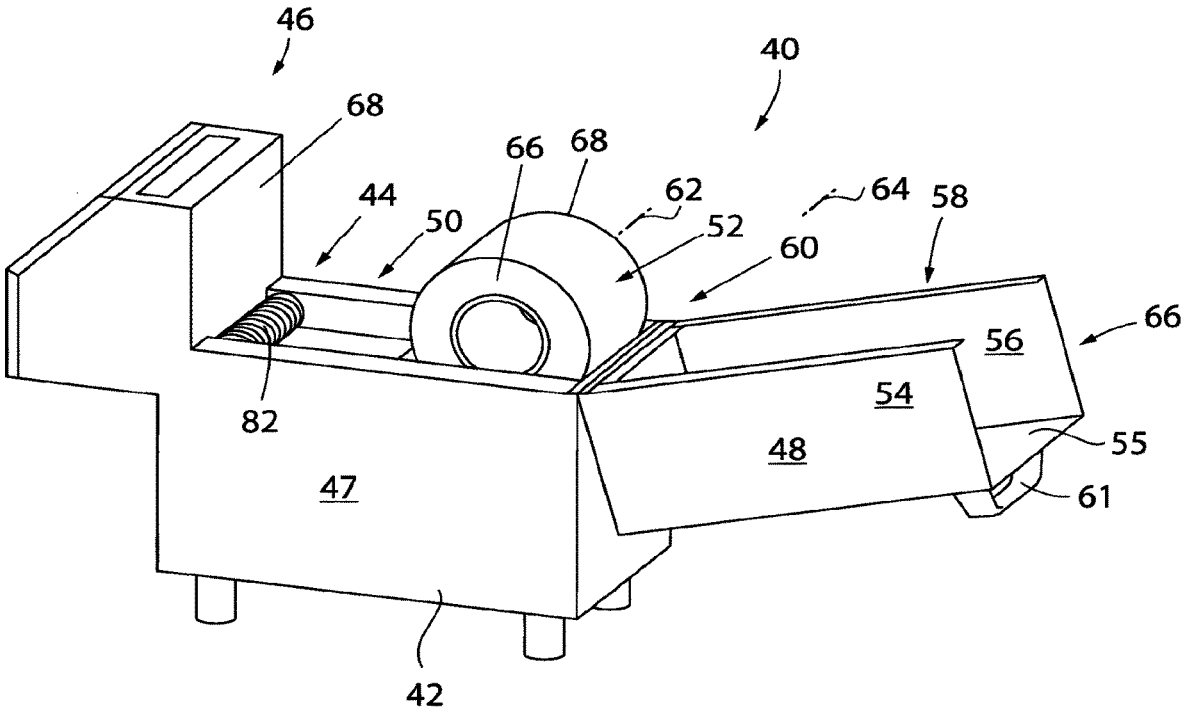
FIG. 1 is a perspective view of a heat sealing container lidding system according to the present invention.

FIG. 1 shows a heat seal lidding device or system 40 according to one aspect of the present application. In accordance with the application, as broadly described, the lidding system 40 may include various connectable modular subassemblies such as a housing 42, a feed assembly 44 generally contained therein, and a sealing assembly 46 associated therewith.

Housing 42 includes a base 47 and the cover 48 that is pivotably connected thereto. Base 47 defines a chamber 50 that is constructed to accommodate feed assembly 44, at least a portion of a bulk roll 52 of a film material associated therewith, and a chassis 43. The film may be any film that will shrink in the presence of heat or radiant energy. For example, the film may be a plastic wrapping film which has the capability of shrinking when it is heated to near the melting point of the film. These films are commonly manufactured from plastic resins such as polyvinyl chloride (PVC); polypropylene (PP); linear-low density polyethylene (LLDPE); low densitypolyethylene (LOPE); high density polyethylene (HOPE); copolymers of ethylene and vinyl acetate (EVA); copolymers of ethylene and vinyl alcohols (EVOH); ionomers (e.g., SURLYN™, by E.I. du Pont de Nemours and Company of Wilmington, Del.)); copolymers of vinylidene chloride (e.g., PVDC, SARAN™ ("SARAN" is a trademark of The Dow Chemical Company of Midland, Mich.)); copolymers of ethylene acrylic acid (EAA); polyamides (PA); polyester, polystyrene, nylon and copolymers of ethylene and octene.

It is further appreciated that the film may be a bi-axially oriented thin shrink film having a thickness of between 40 to 120 gauge (1.02 mm to 3.05 mm). In another embodiment, the film may be a bi-axially oriented thin shrink film having a thickness of between 60 to 100 gauge (1.52 mm to 2.54 mm) One film that has been used is a 75 gauge (1.91 mm) Clysar ABL polyolefin shrink film sold by Bemis Corporation of Minneapolis, Minn. Another film that has been used is a 75 gauge (1.91 mm) Clysar XLPT-115 polyolefin shrink film, also sold by Bemis Corporation of Minneapolis, Minn. Yet another appropriate shrink film may be made of polyvinyl chloride and is sold under the trade name #2024 REYNOLON™, by Reynolds Metals Company of Richmond, Va. Appropriate shrink film would be readily apparent to the skilled artisan. Any art recognized film would be appropriate, such as 75 gauge (1.91 mm) Intertape Exfilm polyolefin shrink film. When used to cover food products, the film should be food contact-approved by the appropriate regulatory authorities. In one embodiment, the film should have a width of between approximately 3-12 inches. It is further appreciated that the relative width associated with the desired firm be tailored or selected to cooperate with the shape of an underlying container intended to sealed thereto and with minimal or deminimus waste associated with the same. It is appreciated that the examples provided above are merely exemplary and not all inclusive of suitable materials associated with the film material.

To ensure that the film sufficiently shrinks when contacted by a respective energy signal, the film may include an energy absorbing substance. Any art recognized energy absorbing substance may be used. One or more energy absorbing substances may be used with a single film. The substance(s) may be applied to the film, such as by printing, brushing, spray coating, electrostatic coating, electrodeposition coating, flow coating, roller coating, dip coating, or other means known to those of ordinary skill in the art, or the substances may be incorporated into the shrink film during formation or manufacture thereof. In some cases, such films may require special treatment to be made more adaptable to printing of the energy absorbent material thereon, such as the application of a charged electric field, known as corona treating, which is done before printing to ensure adhesion of the absorbent material, and its carrier vehicle, if any. Other methods of promoting adhesion of the absorbent material include flame treatment or chemical primer application. For other films, such as polyvinyl chloride shrink films, corona treating is not necessary for acceptable printing results.

Although usable with films having various sizes, shapes, constructions and which are responsive to various energy signals, cover 48 includes opposing sidewalls 54, 56 that define a cavity 58 therebetween. A hinge 60 is secured between base 47 and cover 48 such that cover 48 is rotatable relative thereto and supported by base 47 so as to be generally rotatable about an axis, indicated by line 62, that is generally parallel to the axis, indicated by line 64, associated with movement of cover 48 relative to base 47. It is appreciated that axis 62 and axis 64 could be oriented at crossing orientations relative to one another yet achieve the desired exposure or access to the cavity defined by housing 42. As shown in FIG. 1, when cover 48 is oriented in the open position relative to base 47, more than a minority and preferably a majority of the opposing ends 66, 68 associated with roll 52 are generally exposed to atmosphere so as to accommodate more convenient loading of lidding system 40. Cover 48 may also include a handle 61 coupled to sidewall 54, sidewall 56, and/or top wall 55 of cover 48. Handle 61 is offset from the axis of rotation 60 and allows a user to rotate cover 48 between the respective open and closed positions.

Figure 2:
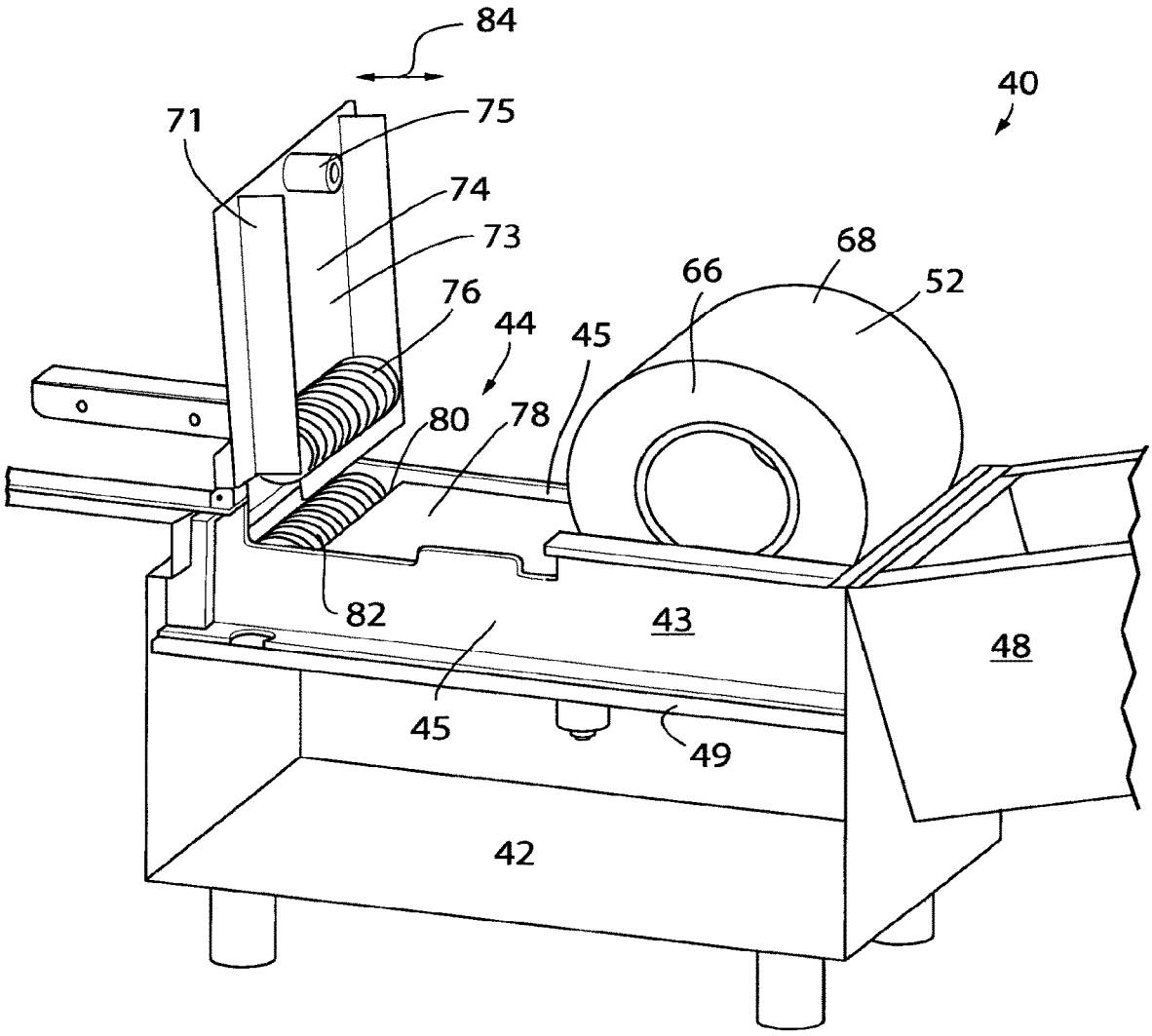
FIG. 2 is a perspective view of a feeding assembly of the heat sealing container lidding system of FIG. 1 rotated to an open or loading orientation relative to a housing or enclosure.

In one embodiment, cover 48 includes an open end 66 that is constructed to generally align with a rearward facing surface 68 associated with sealing assembly 46 when cover 48 is oriented in the closed position relative to base 47. Referring to FIG. 2, sealing assembly 46 is preferably constructed to removably cooperate with housing 42 associated with base 47. Opposing side panels associated with base 47 have been removed from the assembly shown in FIG. 2 to improve the visibility of feed assembly 44 and chassis 43.

Chassis 43 is disposed within base 47 of housing 42 and provides support for feed assembly 44 when disposed within housing 42. While FIGS. 1 and 2 depict chassis 43 as being completely disposed within base 47, it is contemplated that chassis 43 may extend beyond base 47. Chassis 43 includes at least one chassis side plate 45 and a chassis bottom plate 49. Chassis bottom plate 49 preferably extends between the walls of housing 42 and provides support for feed assembly 44. Each chassis side plate 45 is configured to extend generally perpendicular from the chassis bottom plate 49 to provide further support and alignment for the components of the feed assembly 44 as described further below. In one embodiment of the invention, the chassis side plates 45 and the chassis bottom plate 49 may be formed as a single injection molded part. It is further appreciated that side plates 45 and bottom plate 49 may alternatively be formed as separate parts that are connected to one another by any of an interlocking engagement and/or use of supplemental fasteners or the like. As shown in FIG. 2, each chassis side plate 45 may be configured to partially cover a respective end or side 66, 68 of the bulk roll 52.

Feed assembly 44 includes a feed cover 74 that supports feed roll 76 associated with communicating a film material 78 from bulk roll 52 toward sealing assembly 46 during use of system 40. It should be appreciated that the orientation of feed roll 76 and cover 74 associated therewith, in the orientation shown in FIG. 2, is oriented in a loading position relative to housing 42 such that the user/operator can introduce an end 80 associated with film material 78 to a space between feed roll 76 and an opposing roll 82 associated with feed assembly 44.

Figure 3:
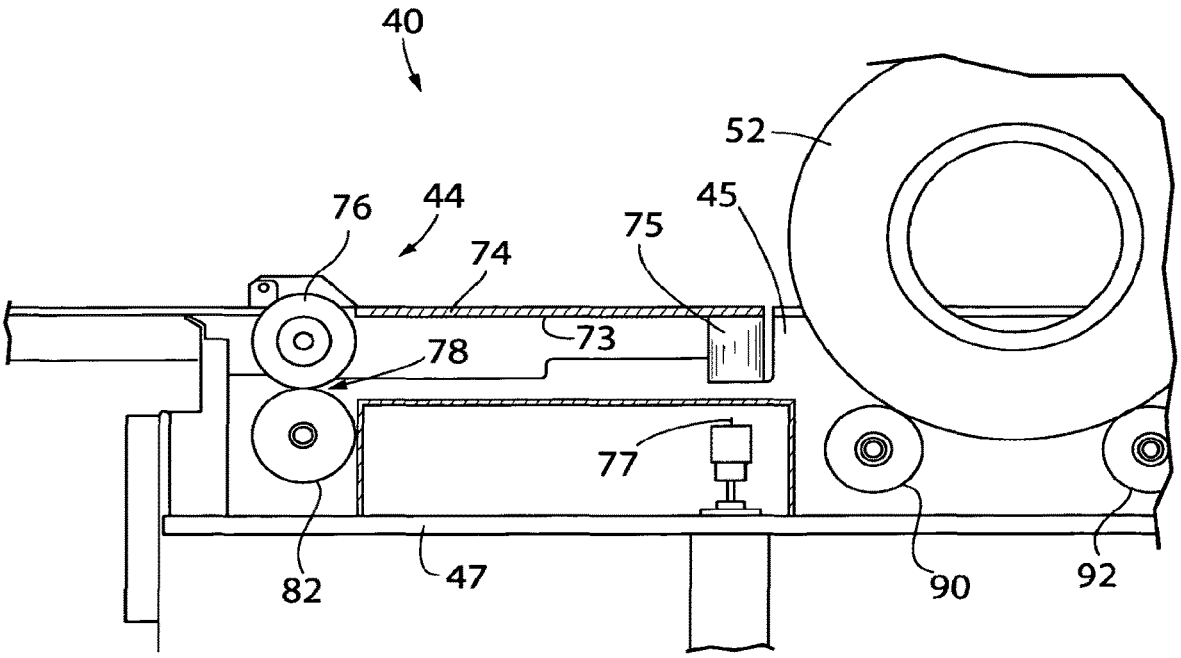
FIG. 3 is a cross-sectional view of the feeding assembly of FIG. 2.

Feed cover 74 is rotatable relative to housing 42 and chassis 43 as indicated by arrow 84 so as to be movable between a loading position as shown in FIG. 2 and a dispensing or use position wherein feed roll 76 is oriented in close proximity to opposing roll 82 and the film material 78 being configured to cooperate therewith to effectuate the feeding of the film material 78 from system 40 to effectuate the desired sealing respective open ends of containers associated therewith. Referring to FIG. 3, orientation of feed cover 74 in the use orientation associated with operation of system 40 allows rolls 76, 82 to interact with one another such that film 78 can be dispensed from bulk roll 52 in a direction toward sealing assembly 46. When cover 48, feed roll 76, and feed cover 74 are oriented in the open orientations as shown in FIG. 2, users can quickly and expeditiously associate a subsequent bulk roll 52 with system 40 for subsequent use or continued sequential operation of system 40 for heat sealing operations.

Figure 4:
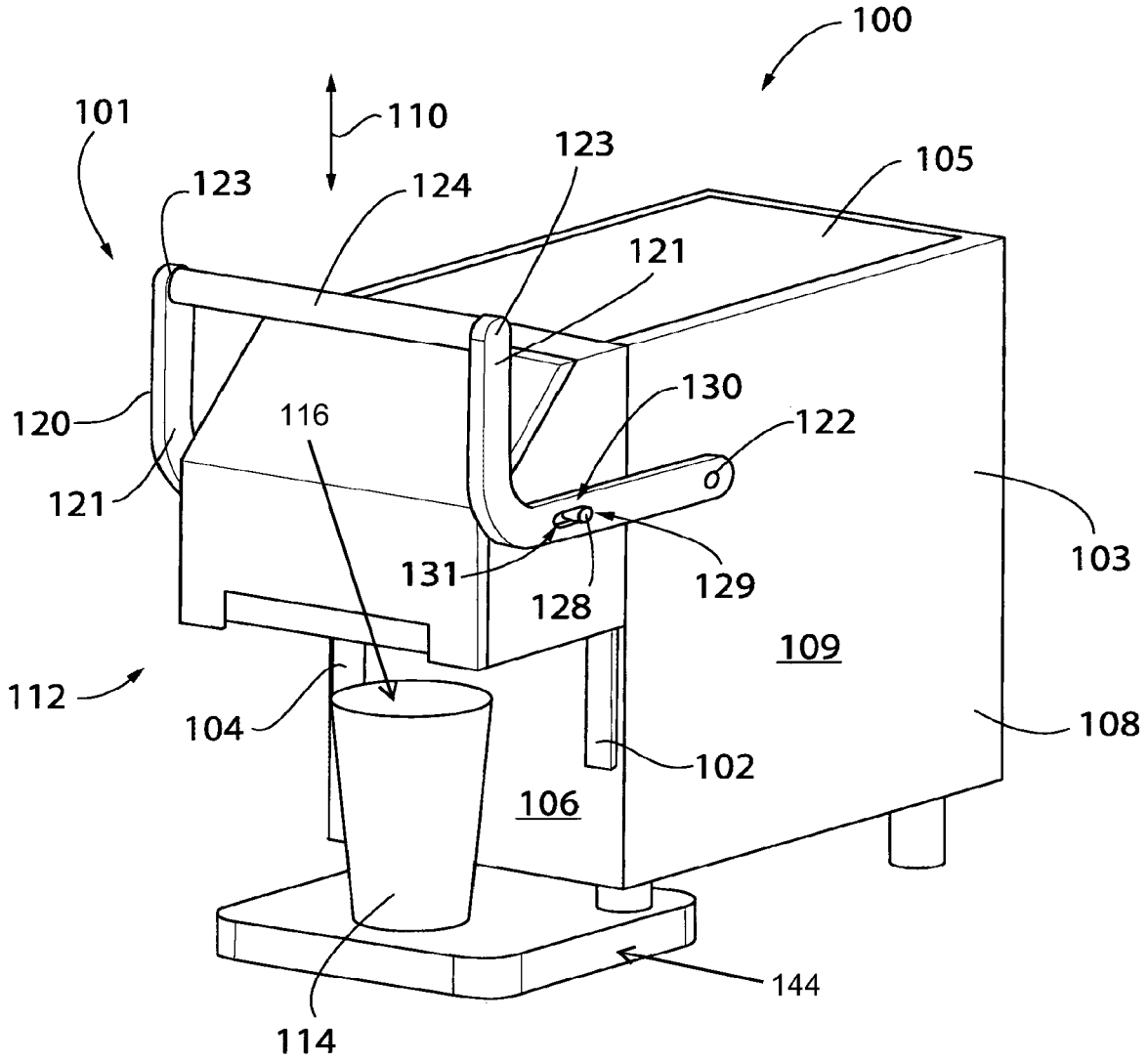
FIG. 4 is a perspective view of a heat sealing container lidding system in a first position, according to another embodiment of the present invention.

As further shown in FIGS. 3 and 4, feed cover 74 may include a blade cover 75 extending from a lower surface 73 thereof. Lower surface 73 of feed cover 74 is the surface adjacent film 78 within feed assembly 44. In some embodiments of the invention, a blade 77 may be disposed within feed assembly 44 and is oriented along a vertical plane aligned with blade cover 75, when feed cover 74 is in the use orientation of FIG. 3. Blade 77 is disposed generally underneath film material 78 and is movable along the vertical plane in order to score or perforate film material 78 to create an opening therein. It is appreciated that blade 77 may be provided in various foul's and may be operable to fully penetrate or perforate film 78, only partially penetrate film 78, and/or form one or more serrations therein wherein the serrations facilitate subsequent penetration of film 78 by a straw, utensil, or the like.

It is contemplated that embodiments of the invention including blade 77 may also include blade cover 75, while embodiments of the invention replacing blade 77 with a fixed position blade 158, such as that shown and described below with respect to FIGS. 6 and 7, may or may not include blade cover 75. In yet other embodiments of the invention, blade 77 may be disposed above film material 78 and movable along the vertical plane to score or perforate film material 78 from above, as opposed to from below as shown in FIG. 3.

Feed cover 74 may also include a plurality of support brackets 71 extending from the lower surface 73 thereof and oriented parallel or substantially parallel to each other. While FIG. 2 depicts two (2) support brackets 71, it is contemplated that any number of support brackets 71 may be used. As shown in FIG. 2, support brackets 71 assist with supporting feed roll 76, which is disposed therebetween.

It is further contemplated that feed cover 74 and its sub-elements, such as support brackets 71 and blade cover 75, may be a single integrated part formed through processes known in the art, such as, but not limited to, injection molding. In other embodiments of the invention, one or more of the sub-elements of feed cover 74 may be separable from one another and configured to be coupled to feed cover 74.

The movability of roll 76 relative to roll 82 associated with feed assembly 44 facilitates convenient and expeditious "threading" of film material 78 relative to system 40 and the feed mechanisms associated therewith during initial threading or reloading operations. It is further appreciated that one or more of roll 76, roll 88 and/or one or more of support rolls 90, 92 associated with bulk roll 52 can be powered and/or otherwise driven so as to effectuate the desired unwinding, delivery, and tensioning of film material 78 relative to sealing assembly 46 for generally continuous operation of system 40 while bulk roll 52 includes film material 78. it is further appreciated that housing 42, feed assembly 44, and sealing assembly 46 can include one or more supplemental feed, support, guide, and/or tension rollers configured to achieve the desired translation of film material 78 during dispensing operations as disclosed in the prior art mentioned above.

Figure 5:
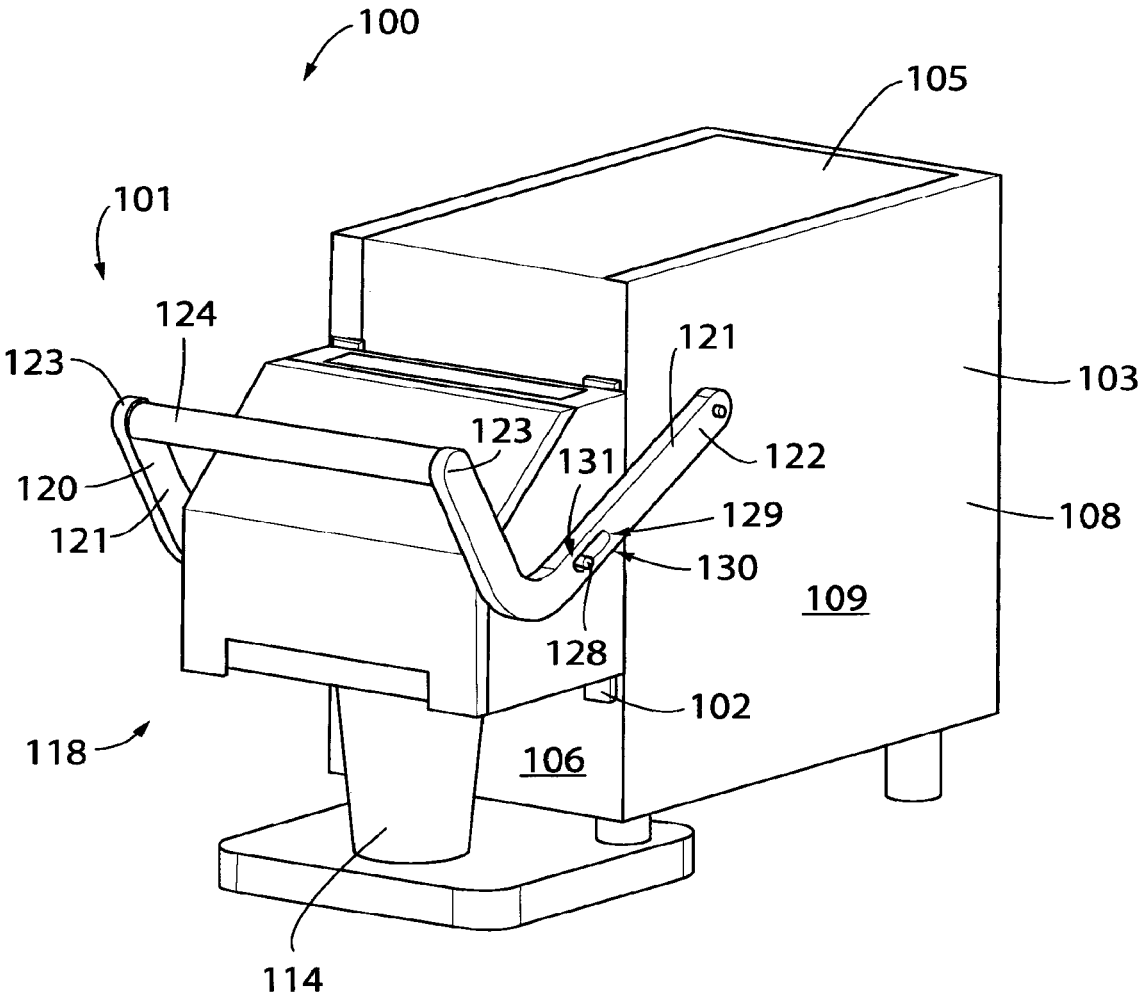
FIG. 5 is a perspective view of the heat sealing container lidding system of FIG. 4 in a second position.

FIGS. 4 and 5 show a heat seal lidding device or system 100 according to another embodiment of the application. Unlike sealing assembly 46, system 100 includes a sealing assembly 101 that is translatable relative to the housing or enclosure associated with supporting the bulk roll of heat sealing material. Sealing assembly 101 is coupled to a generally forward-facing surface 106 of a housing 103 that includes an access panel 105 and an enclosure 108 associated therewith. In other embodiments of the invention, system 100 may include a housing having a selectively operable cover pivotably associated with a base, such as that disclosed above with respect to housing 42.

Sealing assembly 101 is constructed to movably cooperate with enclosure 108 in a generally vertical direction, indicated by arrow 110. A first rail 102 and a second rail 104 are secured to surface 106 of enclosure 108 and configured to allow sealing assembly 101 to move between a first, ready position 112, as shown in FIG. 4, associated with accommodating placement of an open-ended container 114 relative thereto, and a second, seal application position 118 relative to enclosure 108 wherein film material associated therewith can be sealingly engaged with the open end 116 of container 114. In varying embodiments of the invention, more or less than two (2) rails may be secured to surface 106.

System 40 includes a handle 120 that allows a user to transition sealing assembly 101 between first position 112 and second position 118. Handle 120 includes a number of arms 121 that each have a similar shape and orientation such that they are generally mirror images of one another. Each arm 121 pivotably connects to a side-facing surface 109 of enclosure 108 at a first end 122 of the arm 121. Handle 120 further includes a grip site 124 that extends in a generally perpendicular manner between a second, generally opposite end 123 of each arm 121. Sealing assembly 101 includes a projection 128 that extends in an outward lateral direction relative to axis 110 and which slideably cooperates with a guide or channel 130 formed along arm 121. Projection 128 and channel 130 are shaped to accommodate generally vertical rotation, as indicated by arrow 134, of handle 120 relative to enclosure 108 while allowing substantially vertical translation, along axis 110, of sealing assembly 101 relative to container 114.

When a user pushes in a generally downward direction on grip 124 to lower sealing assembly 101, handle 120 rotates about first end 122 of arm 121 in a generally counterclockwise direction, while protrusion 128 travels from a first end 129 of channel 130 toward a second end 131 of channel 130. When a user interacts with grip 124 to raise sealing assembly 101, handle 120 is configured to rotate about first end 122 of arm 121 in a generally clockwise direction, while protrusion 128 travels in a direction away from second end 131 of channel 130 toward first end 129 of channel 130. It is further appreciated that system 100 can include a biasing device associated with handle 120 such that, after a sealing operation, handle 120 returns to the "ready to seal" or first position 112 when the downward bias associated with user interaction with handle 120 is removed therefrom.

Regardless of the return to "ready to seal" methodology employed associated with user interaction with handle 120, the substantially vertical translation of sealing assembly 100 ensures that the desired interaction is achieved between an underside 140 of sealing assembly 100 and open end 116 of container 114 during sealing operations. As disclosed above, in a preferred aspect, sealing assembly 100 is biased toward the upward oriented "ready to seal" position 112 when no pressure is exerted on handle 120. In another preferred aspect, a signal is provided that designates an acceptable seal has been created. It is appreciated that such a signal can be one or more of visual, tactile, and/or audible.

The generally slidable association between sealing assembly 101 and a chassis or enclosure 108 further provides for a variable distance, as indicated by dimension 142, between underside 140 of sealing assembly 100 and a foot or support assembly 144 associated therewith. Such a construction allows system 100 to provide a sealable interaction with container's having various sizes and shapes while maintaining a desired interaction between sealing assembly 101 and a respective open end 116 of a respective container associated therewith.

Figure 6:
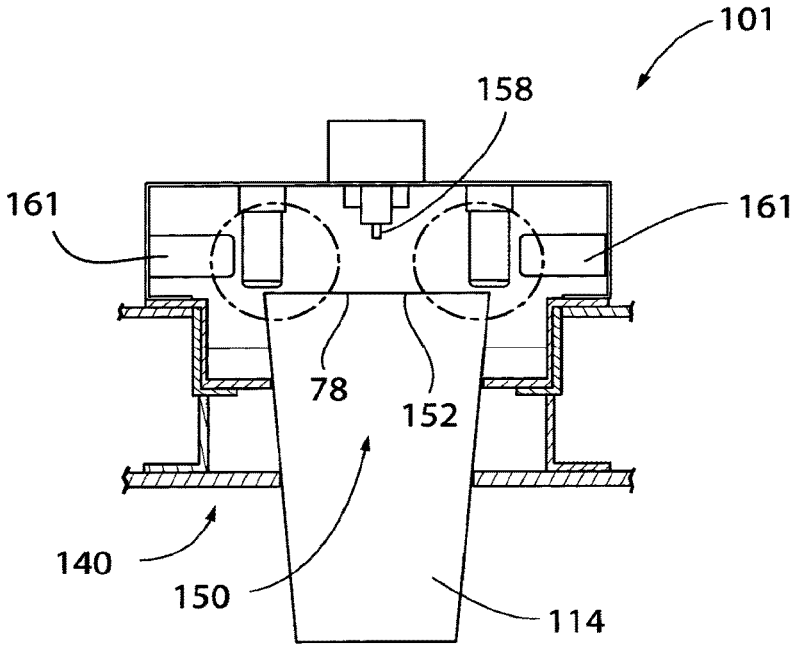
FIGS. 6 and 7 are cross-sectional views of a container within a sealing assembly of the heat sealing container lidding system of FIGS. 4 and 5 with the sealing assembly oriented in respective first and second positions relative to an open topped container associated therewith.
Figure 7:
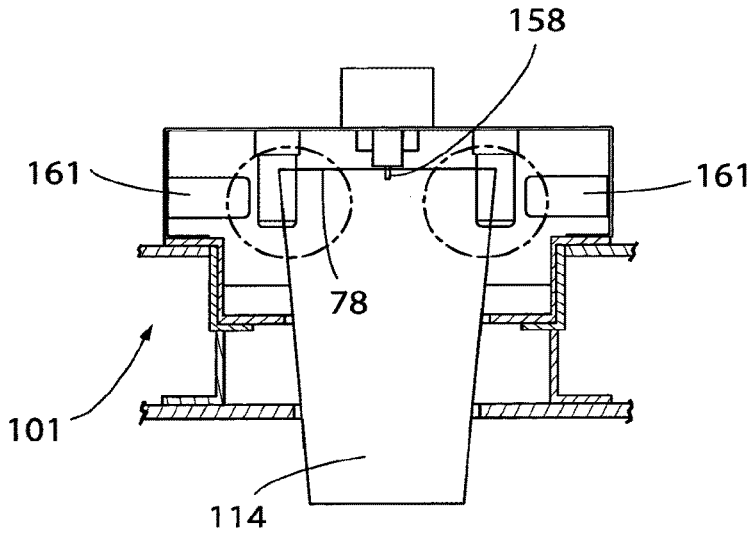

FIGS. 6 and 7 show a further aspect of sealing assembly 101. Referring to FIGS. 6 and 7, sealing assembly 101 preferably includes a selectively engageable, but fixed position blade 158, whose implementation forms a weakened section and/or partially or fully scores or perforates film material 78 during the sealing operation. When configured to perforate film material 78, blade 158 creates an opening therein. As shown in FIGS. 6 and 7, vertical introduction of container 114 with sealing assembly 46 provides interaction between film material 78, an open end of container 114, and an energy emitting device 161 to effectuate the sealing process. As shown in FIG. 6, positional association of container 114 with an opening 150 associated with underside 140 of sealing assembly 100 seals film material 78 to the upper perimeter edge 152 of container 114.

Referring to FIG. 7, vertical translation of container 114, blade 158, and/or sealing assembly 101 relative to the plane associated with film material 78 allows blade 158 to score or perforate film material 78 associated with container 114 so as to score or form a perforation associated therewith. It is appreciated that such scores or perforations can be shaped to accommodate passage of an implement, such as a straw, utensils, or the like into the volume defined by container 114. It is appreciated that such openings and/or partial penetrations may have other shapes and/or be configured for use with other implements and may be provided in various methodologies associated with forming an opening in the film 78 during the sealing operation or forming a line of weakness suitable for later forming of a perforation or opening associated with accessing the contents of sealed containers.

Figure 8:
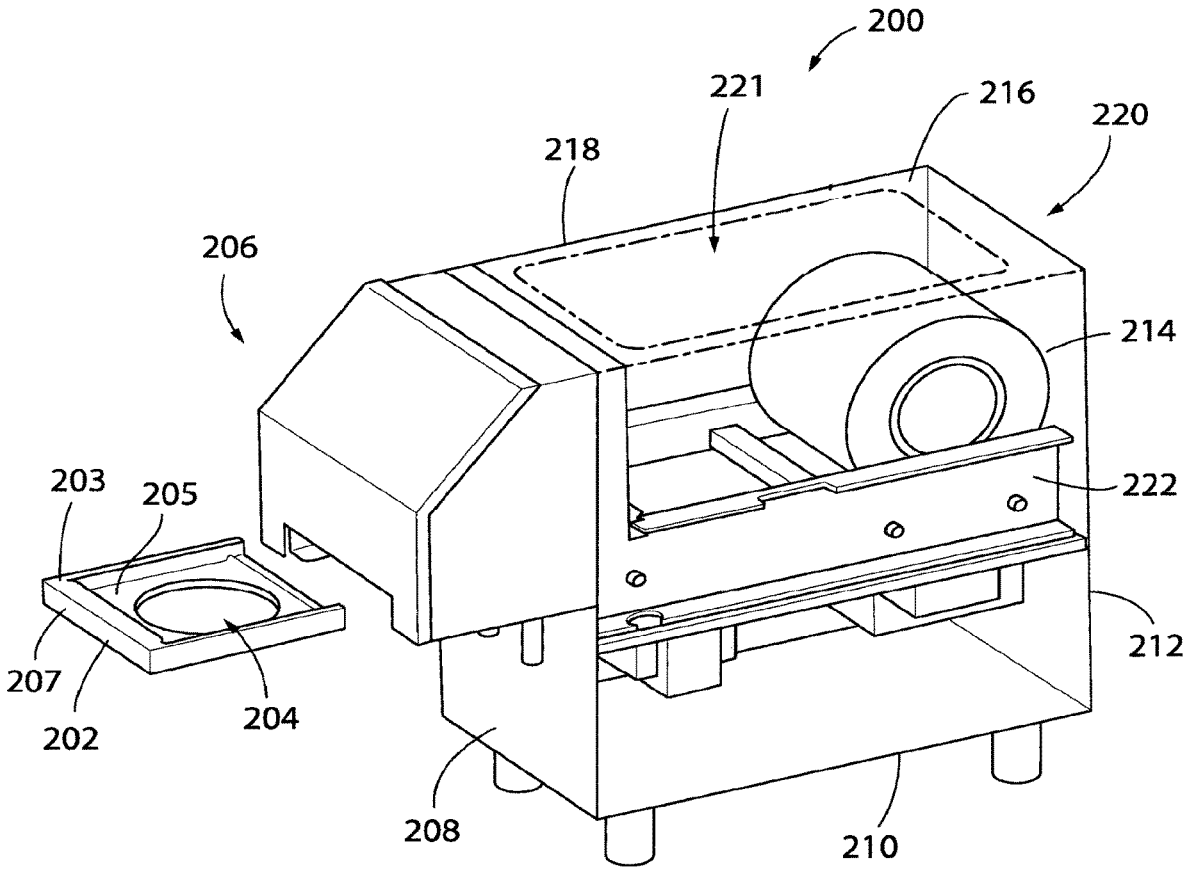
FIG. 8 is a perspective view of a heat sealing container lidding system, according to another embodiment of the present invention.

Referring to FIG. 8, a heat seal lidding device or system 200 is shown according to another aspect of the present application and is directed to improving the versatility associated with the formation and use of lidding system 200. As shown therein, system 200 preferably includes an interchangeable tray 202 that defines opening 204 of sealing system 206, similar to opening 150 of sealing system 101 shown in FIGS. 4-7. As shown in FIG. 8, tray 202 may have a generally C-shaped profile, wherein a top wall 203 and a bottom wall 205 both overhang at least one of the sidewalls 207 of tray 202 and such that an opening 204 is generally defined in bottom wall 205.

It is contemplated that tray 202 can be provided in various configurations other than the generally C-shaped profile described above. Preferably, tray 202, one or more of panels 208, 210,212,214,216,218 associated with the formation of housing 220, and chassis 222 are formed of an injection molded plastic material. It is appreciated that such a configuration reduces the cost associated with formation and improves the versatility of systems 40, 100, 200 as compared to prior art appliances wherein systems 40, 100, 200 can be quickly, efficiently, and economically configured to provide heat sealing operations with containers having various shapes and sizes. It should be noted that side panel 214, top panel 216, and lid 221 have been depicted as transparent in FIG. 8 to improve the visibility of feed assembly 221 and chassis 222 disposed within housing 220.

With respect to tray 202, it is further appreciated that opening 204 can be provided in various shapes and contours specific to a shape of an underlying container, such as container 114, as shown in FIGS. 4-7, for the desired interaction of the respective container with sealing assembly 206. Such considerations reduce the cost associated with the formation of system 200 as well as the convenience with which the discrete respective system 200 can be configured to accommodate and/or provide sealed interaction with container's having alternate shapes and/or sizes. For instance, it is appreciated that system 200 can be provided with a plurality of trays 202 wherein each tray includes an opening 204 that is sized and shaped to cooperate with a discrete group of containers that are sized and shaped to cooperate with the discrete opening 204 and interact with heat sealing system 200 in the manner disclosed above.

While the elements above are described as being a part of a particular system 40, 100, 200, it is contemplated that other embodiments of the invention may include one or more of the discreet elements from each of the multiple discrete heat sealing systems 40, 100, 200 described above. For example, the present invention contemplates an embodiment including the feed assembly 42 of FIG. 1 with the sealing assembly 101 of FIG. 4. It is appreciated that the discrete elements described above with respect to container lidding systems 40, 100, 200 are not mutually exclusive from each other.

Another aspect of the present application is directed to providing an indicia or other marking associated with the contents of a discrete container during the sealing process. In one aspect, film material 78 is provided to be or includes a layer that is responsive to laser energy. A laser can be supported by either of housing 42, feed assembly 44, or sealing assembly 46 and positioned in proximity to film material 78 such that the laser energy manipulates or creates a desired indicia in the film material. In a preferred aspect, the indicia can be designed, designated, or selected by the user or operator of system 40 and provide an indication as to the contents and/or source of the sealed containers produced by container lidding systems 40, 100, 200. While the above is described with respect to system 40 as shown in FIGS. 1-3, it is appreciated that the indicia forming system may also be included in system 100 as shown in FIGS. 4-7 and/or system 200 as shown in FIG. 8.

Container lidding systems 40, 100, and 200 provide assemblies that can be economically produced and deployed. System 40 further simplifies the lid film material loading operations as compared to known systems. Systems 100 and 200 further provide a lidding system that is useable with containers of various sizes, shapes, and blind opening sizes, shapes, and configurations associated therewith. Systems 40, 100, and 200 further provide more economical and more easily maintained indicia and perforation generating subassemblies.

Other embodiments of the invention will be apparent to those skilled in the art from consideration of the specification and practice of the invention disclosed herein. It is intended that the specification and examples provided therein be considered as exemplary only, with a true scope and spirit of the invention being indicated by the following claims.

What is claimed is:

1. A system for heat-shrinking film material onto an open-topped container, the system comprising:

a feed mechanism configured to cause the film material to advance from a film material roll to a dispense location, wherein the feed mechanism includes a feed cover and a feed roll, wherein the feed cover is movable between a use position and a loading position, wherein, when the feed cover is in the loading position, the feed roll is spaced apart from an opposing roll so as to enable loading of the film material therebetween, wherein, in operation, when the feed cover is in the use position, rotation of at least one of the feed roll and the opposing roll causes the film material to advance to the dispense location;

a seal assembly proximate the dispense location and configured to allow contact between the film material and an open end of the open-topped container in operation, wherein the seal assembly is configured to translate vertically toward the open end of the open-topped container prior to causing the film material to seal to the open end of the open-topped container via application of energy.

2. The system of claim 1, wherein the seal assembly is configured to perforate the film material, the perforation configured to allow for an implement to pass through a region defined by the perforation.

3. The system of claim 1, wherein the seal assembly is configured to provide a line of weakness on the film material, the line of weakness configured to allow for an implement to pass through a region defined by the line of weakness.

4. The system of claim 1, wherein the film material roll is supported by one or more support rolls.

5. The system of claim 1, wherein the film material is under tension relative to the seal assembly prior to the film material being sealed.

6. The system of claim 1, further comprising a laser configured to print indicia on the film material.

* * * * *